US010174581B2

(12) United States Patent
Prieto et al.

(10) Patent No.: US 10,174,581 B2
(45) Date of Patent: Jan. 8, 2019

(54) METHOD AND APPARATUS TO UTILIZE A DEFORMABLE FILLER RING

(71) Applicants: Carlos Prieto, Katy, TX (US); Edward Wood, Kingwood, TX (US); John K. Wakefield, Cypress, TX (US); Aubrey C. Mills, Magnolia, TX (US)

(72) Inventors: Carlos Prieto, Katy, TX (US); Edward Wood, Kingwood, TX (US); John K. Wakefield, Cypress, TX (US); Aubrey C. Mills, Magnolia, TX (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 458 days.

(21) Appl. No.: 14/921,785

(22) Filed: Oct. 23, 2015

(65) Prior Publication Data

US 2017/0114607 A1 Apr. 27, 2017

(51) Int. Cl.
*E21B 33/12* (2006.01)
*E21B 33/128* (2006.01)

(52) U.S. Cl.
CPC ..... *E21B 33/128* (2013.01); *E21B 33/1208* (2013.01); *E21B 33/1216* (2013.01)

(58) Field of Classification Search
CPC . E21B 33/1208; E21B 33/1216; E21B 33/128
See application file for complete search history.

(56) References Cited

U.S. PATENT DOCUMENTS 4,441,721 A * 4/1984 Harris ..... E21B 33/1208 277/342
4,522,368 A * 6/1985 Sable ..... E21B 33/06 166/84.4
4,765,404 A * 8/1988 Bailey ..... E21B 7/061 166/117.6
6,041,858 A 3/2000 Arizmendi
6,827,150 B2 12/2004 Luke
7,128,145 B2 10/2006 Mickey
2004/0069502 A1 4/2004 Luke
2006/0243457 A1* 11/2006 Kossa ..... E21B 33/1208 166/387

(Continued)

*Primary Examiner* — Waseem Moorad
*Assistant Examiner* — Christopher J Sebesta
(74) *Attorney, Agent, or Firm* — Cantor Colburn LLP

(57) ABSTRACT

In one embodiment, a filler ring for use with a packer element with a packer element radial stiffness and a packer element confined circumferential stiffness is disclosed, including, a filler ring body with a filler ring body radial stiffness greater than the packer element radial stiffness and a filler ring body circumferential stiffness less than the packer element confined circumferential stiffness. In another embodiment, a method to selectively deform a packer element with a packer element radial stiffness and a packer element confined circumferential stiffness is disclosed, including providing a filler ring body with a filler ring body radial stiffness greater than the packer element radial stiffness and a filler ring body circumferential stiffness less than the packer element confined circumferential stiffness, deforming the packer in a radial direction via the filler ring body, deforming the filler ring body in an axial direction in response to deformation of the packer element.

18 Claims, 3 Drawing Sheets

(56) References Cited

U.S. PATENT DOCUMENTS

| | | | | |
|---|---|---|---|---|
| 2008/0060821 | A1* | 3/2008 | Smith | E21B 33/1216 166/387 |
| 2012/0217003 | A1* | 8/2012 | Yee | E21B 33/1208 166/129 |
| 2013/0306331 | A1* | 11/2013 | Bishop | E21B 33/1216 166/387 |

* cited by examiner

METHOD AND APPARATUS TO UTILIZE A DEFORMABLE FILLER RING

BACKGROUND

Field of the Disclosure

This disclosure relates generally to filler rings and packers that utilize the same for downhole applications.

Background of the Art

Wellbores are drilled in subsurface formations for the production of hydrocarbons (oil and gas). In many operations it is required to isolate certain zones of production in downhole locations to facilitate production of oil and gas. Packers are often utilized to isolate zones of production and can be used in both cased and open hole applications. Certain packers are high expansion packers that expand the packing element of the packer significantly. Such high expansion packers may experience high levels of stress, tearing, and damage to the packing element since conventional filler rings within the packer may prevent the transfer of stresses and forces within the packing element. It is desired to provide a filler ring and a packer that can allow for high levels of packing element expansion without damage to the packing element.

The disclosure herein provides filler rings and packers that utilize the same for downhole applications.

SUMMARY

In one aspect, a filler ring for use with a packer element with a packer element radial stiffness and a packer element confined circumferential stiffness is disclosed, including, a filler ring body with a filler ring body radial stiffness greater than the packer element radial stiffness and a filler ring body circumferential stiffness less than the packer element confined circumferential stiffness.

In another aspect, a method to selectively deform a packer element with a packer element radial stiffness and a packer element confined circumferential stiffness is disclosed, including providing a filler ring body with a filler ring body radial stiffness greater than the packer element radial stiffness and a filler ring body circumferential stiffness less than the packer element confined circumferential stiffness, deforming the packer in a radial direction via the filler ring body, deforming the filler ring body in an axial direction in response to deformation of the packer element.

In another aspect, a packer is disclosed, including, a packer element with a packer element radial stiffness and a packer element confined circumferential stiffness, and a filler ring body with a filler ring body radial stiffness greater than the packer element radial stiffness and a filler ring body circumferential stiffness less than the packer element confined circumferential stiffness.

Examples of certain features of the apparatus and method disclosed herein are summarized rather broadly in order that the detailed description thereof that follows may be better understood. There are, of course, additional features of the apparatus and method disclosed hereinafter that will form the subject of the claims appended hereto.

BRIEF DESCRIPTION OF THE DRAWINGS

The disclosure herein is best understood with reference to the accompanying figures, wherein like numerals have generally been assigned to like elements and in which.

DESCRIPTION OF THE EMBODIMENTS

Figure 1:
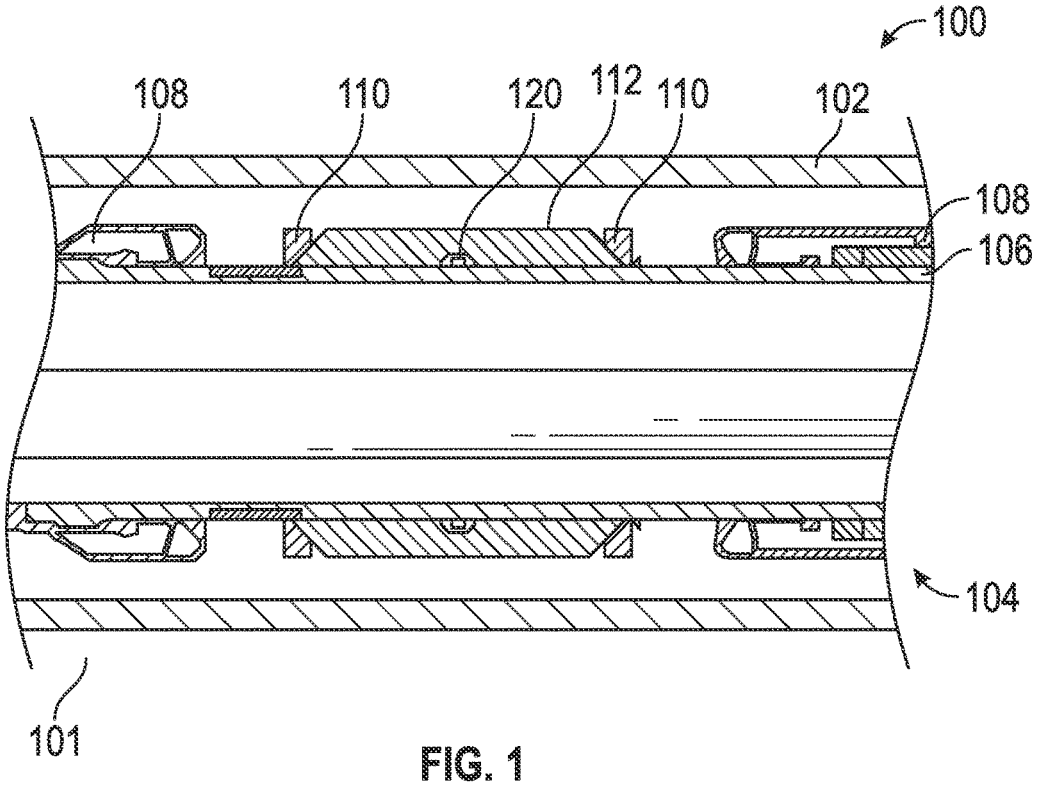
FIG. 1 is a schematic cross sectional diagram of an exemplary downhole system that includes a packer according to embodiments of the disclosure.

FIG. 1 shows an exemplary embodiment of a downhole system to facilitate the production of oil and gas. In an exemplary embodiment, the downhole system 100 includes a casing 102 and a packer 104. In certain embodiments, the downhole system 100 can include the packer 104 disposed in an open wellbore 101.

In an exemplary embodiment, a wellbore 101 is drilled from a surface to a downhole location. Casing 102 may be disposed within wellbore 101 to facilitate production. Wellbore 101 may be a vertical wellbore, a horizontal wellbore, a deviated wellbore or any other suitable type of wellbore or any combination thereof.

To facilitate downhole operations the packer 104 can be utilized within the wellbore 101 either with or without the casing 102. In an exemplary embodiment, the packer 104 is used to isolate zones and wellbore fluids. In certain embodiments, a high expansion packer 104 can allow fluid isolation when expanded in larger casings and open wellbores 101 while maintaining a smaller diameter in a run in position.

In an exemplary embodiment, the packer 104 includes a mandrel 106, a setting device 108, split rings 110, packing element 112, and a filler ring 120. The packer 104 can be utilized to isolate fluid flow within high pressure and high temperature environments. Advantageously, the filler ring 120 allows for greater expansion of the packer element 112 without damage to the packing element 112.

In an exemplary embodiment, the mandrel 106 can allow flow therethrough. In an exemplary embodiment, the setting device 108 can slide on the mandrel 106. In certain embodiments, the setting device 108 can be set, pushed, or otherwise engaged by an external device conveyed to a downhole location. The setting device 108 can engage and act upon the split rings 110 to expand the packing element 112.

In an exemplary embodiment, the split rings 110 are engaged by the setting device 108. As the split rings 110 engage the packing element 112, they can impart an inward force upon the packing element 112. As best shown in FIGS. 2A-2D, the split rings 110 include an open portion. Advantageously, the split geometry of the split rings 110 allows for greater expansion of the split rings 110 to allow greater expansion of the packing element 112.

In an exemplary embodiment, the packing element 112 can be expanded to isolate fluid flow in a desired zone or location. Before the packing element 112 is expanded, the packer 104 can be deployed with the packing element 112 in a run in, or unexpanded position. In an exemplary embodiment, the packing element 112 expands to provide a fluid seal with casing 102 or the wellbore 101. In conjunction with split rings 110 and setting device 108 the packing element 112 can be utilized for high expansion applications. In an exemplary embodiment, the packing element 112 can be formed from an elastomeric material. Certain elastomeric materials may be utilized for various strength and sealing characteristics. In certain embodiments, the geometry of the packing element 112 can be designed to allow for high expansion as well as prevent damage. The packing element 112 can have a radial stiffness and a circumferential stiffness to allow for suitable sealing and pressure resistance. In an exemplary embodiment, when the packing element 112 is confined between the setting device 108 the split rings 110, the casing 102 and/or the borehole 101, the packing element 112 can have a confined circumferential stiffness. The confined circumferential stiffness describes the stiffness of the packing element 112 when it is under pressure on all surfaces. In certain embodiments, the confined circumferential stiffness of the packing element 112 is greater than the circumferential stiffness of the packing element 112. In certain embodiments, the stiffness characteristic of the packing element 112 can return from the confined circumferential stiffness to the circumferential stiffness when pressure is removed.

In an exemplary embodiment, the packer 104 includes a filler ring 120. The filler ring 120 initiates the expansion of the packing element 112 by providing radial support to the packing element 112 to direct the packing element 112 to expand outward instead of deforming inward toward the mandrel 106. Further, in certain embodiments, such as in high expansion packers 104, the packing element 112 can engage the filler ring 120 after initially expanding outward (as shown in FIGS. 2A-2D).

In an exemplary embodiment, the use of split rings 110 to engage the packing element 112 can create unequally distributed axial or circumferential stresses and forces. Advantageously, the filler ring 120 can facilitate the transfer of axial forces by allowing axial movement of the filler ring 120. In an exemplary embodiment, the filler ring 120 can provide a radial stiffness greater than the radial stiffness of the packing element 112 to direct the packing element 112 to expand outward and further provide axial movement circumferentially to allow the transfer of stresses and forces within the packing element 112 in an axial direction. Advantageously, the axial movement of the filler ring 120 can prevent undesirable stress distributions within the packing element 112 to prevent damage to the packing element 112.

In an exemplary embodiment, the filler ring 120 can be formed from a desired material to provide a radial stiffness greater than the radial stiffness of the packing element 112 and a circumferential stiffness less than the confined circumferential stiffness of the packing element 112. In certain embodiments, the circumferential stiffness of the filler ring 120 is less than the circumferential stiffness of the packing element 112 and less than the confined circumferential stiffness of packing element 112. In other embodiments, the circumferential stiffness of the filler ring 120 is greater than the circumferential stiffness of the packing element 112 but less than the confined circumferential stiffness of packing element 112. Therefore, in certain embodiments, the filler ring 120 can deform in an axial direction to become a longer circumferential body. In an exemplary embodiment, the filler ring 120 can be any suitable material, including, but not limited to polytetrafluoroethylene (PTFE), glass filled PTFE, or any other material with a low elongation characteristic while being considerably stiffer than the packing element 112.

Figure 2A:
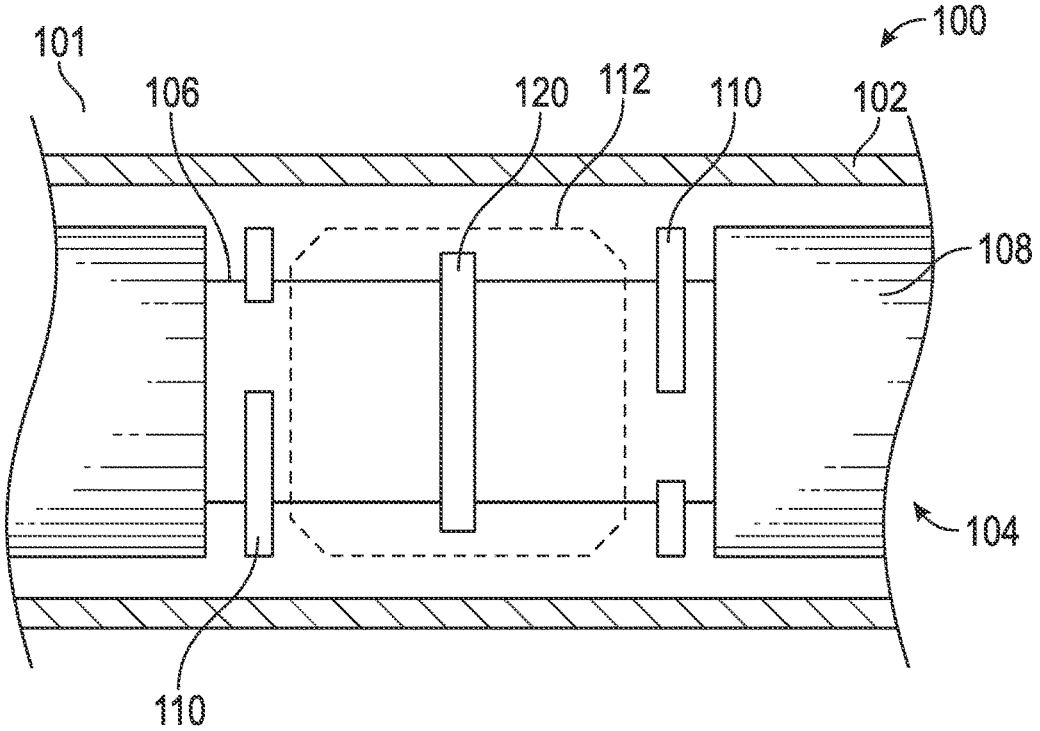
FIG. 2A is a schematic diagram of the packer according to one embodiment of the disclosure wherein the packing element is shown transparently.

FIGS. 2A-2D show an exemplary embodiment of a packer 104 with filler ring 120 during expansion of packing element 112. Referring to FIG. 2A, the packer 104 is shown in a side elevation view, wherein the packing element 112 is illustrated transparently in a dashed line to show the filler ring 120 disposed underneath the packing element 112.

Figure 2B:
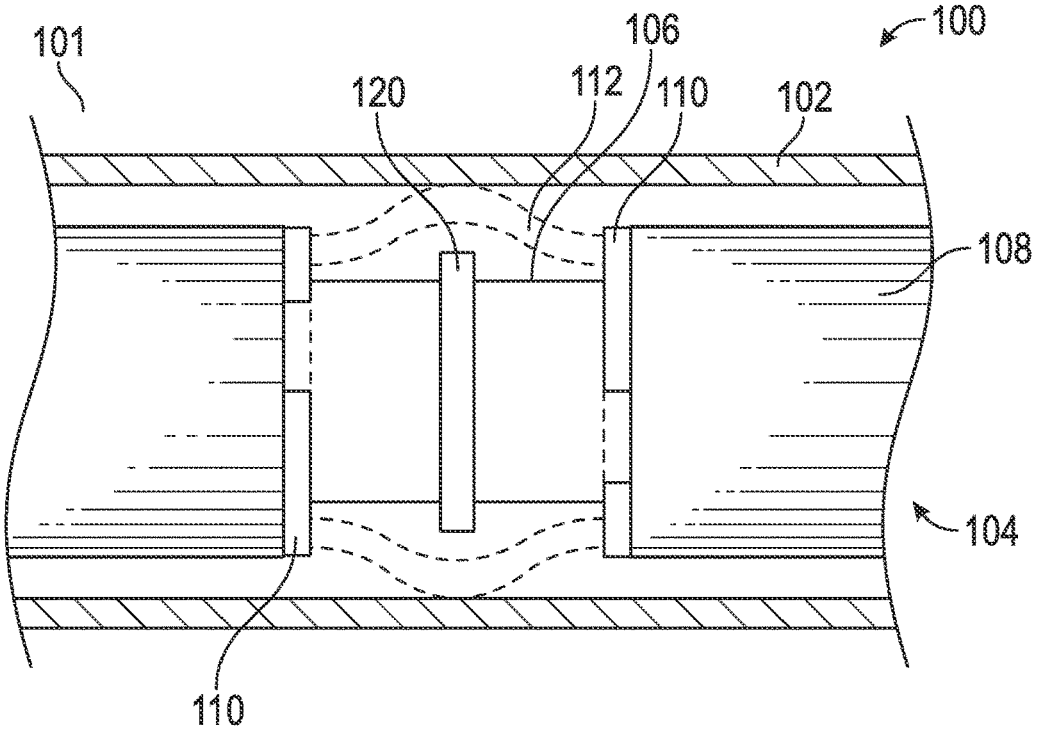
FIG. 2B is a schematic diagram of the packer shown in FIG. 2A wherein the packing element is partially engaged.

Referring to FIG. 2B, the setting devices 108 have been pushed by an external device to engage and push the split rings 110. In an exemplary embodiment, this energizes the packing element 112, causing the packing element 112 to deform. Advantageously, the radial stiffness of filler ring 120 can push the packing element 112 outward to facilitate the initiate outward expansion and prevent inward expansion of the packing element 112.

Figure 2C:
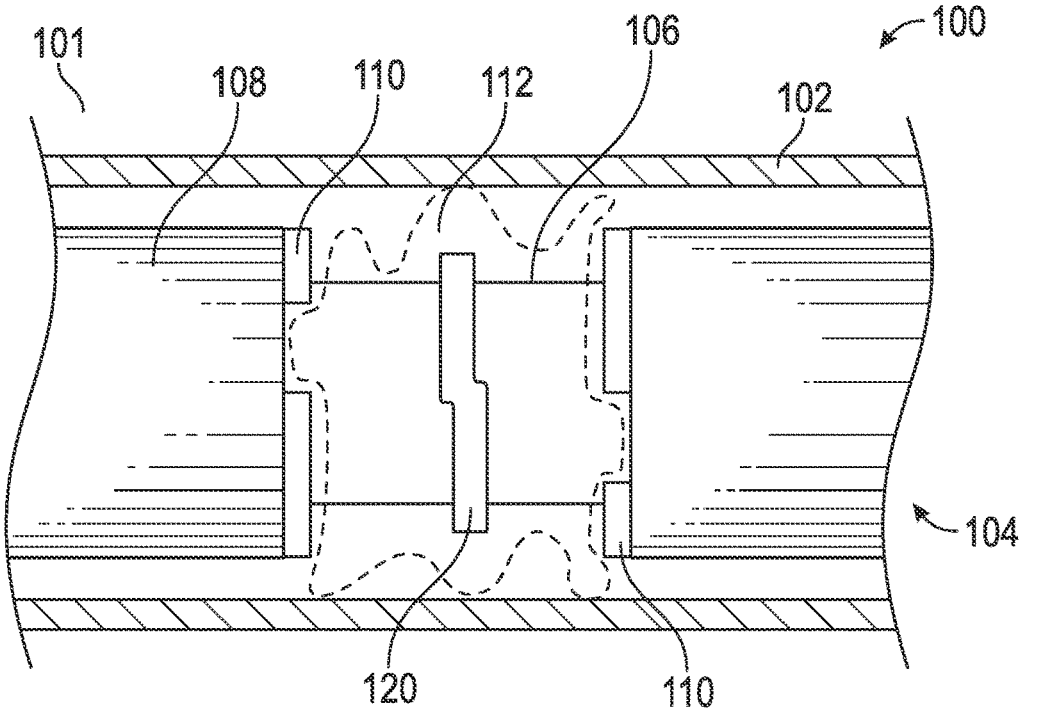
FIG. 2C is a schematic diagram of the packer shown in FIG. 2A wherein the packing element is further engaged.

Referring to FIG. 2C, the setting devices 108 are further moved toward each other to drive the split rings 110 into the packing element 112. The packing element 112 continues to expand and deform and begins to fold back upon itself. In certain embodiments, the packing element 112 can expand and interface with the casing 102. In other embodiments, the packing element 112 can interface directly with the wellbore 101. Due to the geometry of the split rings 110, the packing element 112 may experience unequally distributed axial or circumferential stresses as the packing element 112 is driven by the open geometry of the split rings 110 and portions of the packing element 112 may deform or flow into the open portions of the split rings 110. In an exemplary embodiment, the filler ring 120 facilitates the transfer of axial forces and stresses by deforming in a shape corresponding to the geometry of the split rings 110.

Figure 2D:
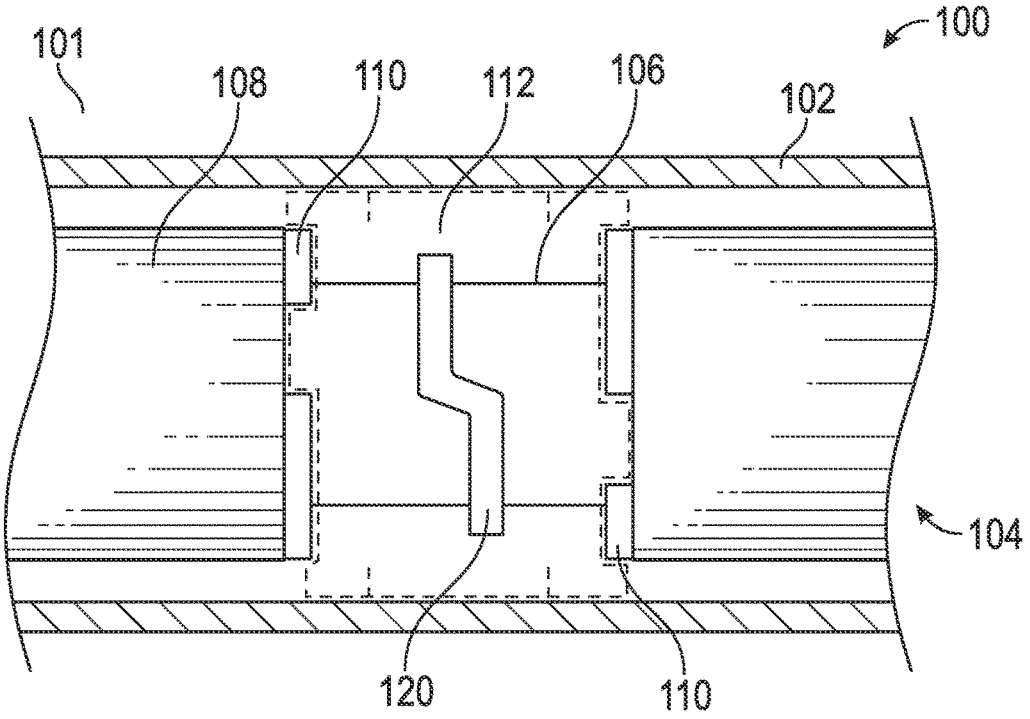
FIG. 2D is a schematic diagram of the packer shown in FIG. 2A wherein the packing element is fully engaged.

Referring to FIG. 2D, the setting device 108 further drives the split rings 110. In an exemplary embodiment, the packing element 112 is fully expanded. In an exemplary embodiment, the packing element 112 has deformed against casing 102. In other embodiments, the packing element 112 can deform against the wellbore 101.

As illustrated, the packing element 112 may experience greater unequally distributed axial or circumferential stresses as the packing element 112 is further driven by the open geometry of the split rings 110. In an exemplary embodiment, the filler ring 120 facilitates the transfer of axial forces and stresses by further deforming in a shape corresponding to the geometry of the split rings 110.

In an exemplary embodiment, the filler ring 120 provides axial movement circumferentially allowing the transfer of stresses and forces within the packing element 112 in an axial direction. Advantageously, the axial movement of the filler ring 120 can prevent undesirable stress distributions within the packing element 112 to prevent damage to the packing element 112.

Figure 3:
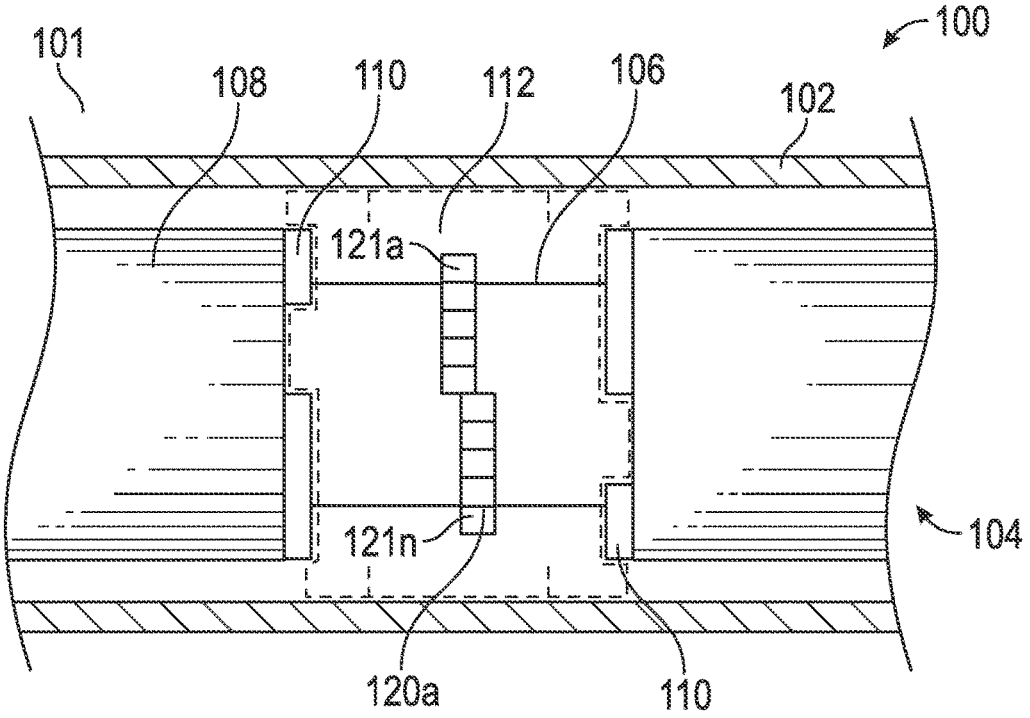
FIG. 3 is a schematic diagram of a packer according to another embodiment of the disclosure wherein the packing element is shown transparently.

Referring to FIG. 3, an alternative embodiment of the packer 104 with a filler ring 120*a* is shown. In certain embodiments, the geometry of the filler ring 120*a* can be altered to provide a circumferential stiffness less than the confined circumferential stiffness of the packing element 112. In certain embodiments, the circumferential stiffness of the filler ring 120*a* is less than the circumferential stiffness of the packing element 112 and less than the confined circumferential stiffness of packing element 112. In other embodiments, the circumferential stiffness of the filler ring 120*a* is greater than the circumferential stiffness of the packing element 112 but less than the confined circumferential stiffness of packing element 112. In an exemplary embodiment, the filler ring 120*a* can be segmented into segments 121*a*-121*n*.

In an exemplary embodiment, the filler ring 120*a* can provide a radial stiffness greater than the radial stiffness of the packing element 112 to direct the packing element 112 to expand outward and further provide axial movement circumferentially to allow the transfer of stresses and forces within the packing element 112 in an axial direction.

In an exemplary embodiment, the filler ring elements 121*a*-121*n* can independently move axially to allow the transfer of stresses and forces within the packing element 112 in an axial direction. Advantageously, the movement of the filler ring elements 121*a*-121*n* can prevent damage to the packing element 112 when used with split rings 110 in high expansion applications. In an exemplary embodiment, the filler ring 120*a* can be any suitable material, including metals, PTFE, glass filled PTFE, etc.

In one aspect, a filler ring for use with a packer element with a packer element radial stiffness and a packer element confined circumferential stiffness is disclosed, including, a filler ring body with a filler ring body radial stiffness greater than the packer element radial stiffness and a filler ring body circumferential stiffness less than the packer element confined circumferential stiffness. In certain embodiments, the filler ring body is formed from polytetrafluoroethylene. In certain embodiments, the filler ring body is formed from glass filled polytetrafluoroethylene. In certain embodiments, the filler ring body is segmented. In certain embodiments, the filler ring is formed from metal.

In another aspect, a method to selectively deform a packer element with a packer element radial stiffness and a packer element confined circumferential stiffness is disclosed, including providing a filler ring body with a filler ring body radial stiffness greater than the packer element radial stiffness and a filler ring body circumferential stiffness less than the packer element confined circumferential stiffness, deforming the packer in a radial direction via the filler ring body, deforming the filler ring body in an axial direction in response to deformation of the packer element. In certain embodiments, the filler ring body is formed from polytetrafluoroethylene. In certain embodiments, the filler ring body is formed from glass filled polytetrafluoroethylene. In certain embodiments, the filler ring body is segmented. In certain embodiments, the method further includes deforming at least one independent segment of the filler ring body. In certain embodiments, the filler ring is formed from metal.

In another aspect, a packer is disclosed, including, a packer element with a packer element radial stiffness and a packer element confined circumferential stiffness, and a filler ring body with a filler ring body radial stiffness greater than the packer element radial stiffness and a filler ring body circumferential stiffness less than the packer element confined circumferential stiffness. In certain embodiments, the packer element is elastomeric. In certain embodiments, the packer further includes at least one split ring to engages the packer element. In certain embodiments, the filler ring body is formed from polytetrafluoroethylene. In certain embodiments, the filler ring body is formed from glass filled polytetrafluoroethylene. In certain embodiments, the filler ring body is segmented. In certain embodiments, the filler ring is formed from metal.

The foregoing disclosure is directed to certain specific embodiments for ease of explanation. Various changes and modifications to such embodiments, however, will be apparent to those skilled in the art. It is intended that all such changes and modifications within the scope and spirit of the appended claims be embraced by the disclosure herein.

The invention claimed is:

1. A filler ring for use with a packer element, comprising:

a filler ring body disposed within the packer element between two split rings to direct the packer element to expand radially outward when the packer element is compressed by the two split rings, wherein the filler ring body transfers unequally distributed axial forces within the packer element by asymmetrically deforming in an axial direction.

2. The filler ring of claim 1, wherein the filler ring body is formed from polytetrafluoroethylene.

3. The filler ring of claim 2, wherein the filler ring body is formed from glass filled polytetrafluoroethylene.

4. The filler ring of claim 1, wherein the filler ring body is segmented.

5. The filler firm of claim 4, wherein the filler firm is formed from metal.

6. A method to selectively deform a packer element, the method comprising:

disposing a filler ring within the packer element between two split rings;

deforming the packer element in a radially outward direction via the filler ring body when the packer element is compressed by the two split rings;

deforming the filler ring body in an axial direction to transfer unequally distributed axial forces within the packer element by asymmetrically deforming in an axial direction.

7. The method of claim 6, wherein the filler ring body is formed from polytetrafluoroethylene.

8. The method of claim 7, wherein the filler ring body is formed from glass filled polytetrafluoroethylene.

9. The method of claim 6, wherein the filler ring body is segmented.

10. The method of claim 9, further comprising deforming at least one independent segment of the filler ring body.

11. The method of claim 9, wherein the filler ring is formed from metal.

12. A packer comprising:

a packer element; and a filler ring body disposed within the packer element between two split rings to direct the packer element to expand radially outward when the packer element is compressed by the two split rings, wherein the filler ring body transfers unequally distributed axial forces within the packer element by asymmetrically deforming in an axial.

13. The packer of claim 12, wherein the packer element is elastomeric.

14. The packer of claim 12, further comprising at least one split ring to engage the packer element.

15. The packer of claim 12, wherein the filler ring body is formed from polytetrafluoroethylene.

16. The packer of claim 15, wherein the filler ring body is formed from glass filled polytetrafluoroethylene.

17. The packer of claim 12, wherein the filler ring body is segmented.

18. The packer of claim 17, wherein the filler ring is formed from metal.

* * * * *